US009579704B2

(12) United States Patent
Shizuku

(10) Patent No.: US 9,579,704 B2
(45) Date of Patent: Feb. 28, 2017

(54) METHOD FOR MANUFACTURING BRASS-PLATED STEEL WIRE AND BRASS-PLATED STEEL WIRE

(71) Applicant: BRIDGESTONE CORPORATION, Chuo-ku, Tokyo (JP)

(72) Inventor: Takahisa Shizuku, Nasushiobara (JP)

(73) Assignee: BRIDGESTONE CORPORATION, Tokyo (JP)

( * ) Notice: Subject to any disclaimer, the term of this patent is extended or adjusted under 35 U.S.C. 154(b) by 154 days.

(21) Appl. No.: 14/358,273

(22) PCT Filed: Nov. 8, 2012

(86) PCT No.: PCT/JP2012/079034

§ 371 (c)(1),
(2) Date: May 15, 2014

(87) PCT Pub. No.: WO2013/073452

PCT Pub. Date: May 23, 2015

(65) Prior Publication Data

US 2014/0315044 A1 Oct. 23, 2014

(30) Foreign Application Priority Data

Nov. 15, 2011 (JP) ..... 2011-249672

(51) Int. Cl.
*B21C 1/16* (2006.01)
*C25D 5/10* (2006.01)
(Continued)

(52) U.S. Cl.
CPC ..... *B21C 1/16* (2013.01); *B21C 1/003* (2013.01); *C23G 1/103* (2013.01); *C25D 5/10* (2013.01);
(Continued)

(58) Field of Classification Search
CPC .. B21C 1/16; B21C 1/003; C25D 5/10; C25D 5/36; C25D 5/48; C25D 7/0607
See application file for complete search history.

(56) References Cited

U.S. PATENT DOCUMENTS 6,093,267 A 7/2000 Arnaud et al.
6,203,932 B1 3/2001 Hisakatu
(Continued)

FOREIGN PATENT DOCUMENTS

CN 101952060 A 1/2011
JP 53-106853 9/1978
(Continued)

OTHER PUBLICATIONS

International Search Report, dated Jan. 22, 2013, issued in International Patent Application No. PCT/JP2012/079034.
(Continued)

*Primary Examiner* — Teresa M Ekiert
(74) *Attorney, Agent, or Firm* — Sughrue Mion, PLLC

(57) ABSTRACT

Provided is a method for manufacturing a brass-plated steel wire in which improvement in the quality of the brass-plated steel wire and energy saving in the manufacturing process are balanced and a brass-plated steel wire obtained by the method.

The method is a method for manufacturing a brass-plated steel wire comprising a plating process in which a steel wire rod is brass plated and a final wire drawing process in which the obtained brass-plated steel wire rod is subjected to a final drawing. The method includes a zinc oxide removing process in which the amount of zinc oxide on the surface of the brass-plated steel wire rod is made smaller than 50 mg/m$^2$ before the final wire drawing process.

7 Claims, 2 Drawing Sheets

(51) Int. Cl.

| | |
|---|---|
| ***C25D 5/48*** | (2006.01) |
| ***C25D 7/06*** | (2006.01) |
| ***D07B 1/06*** | (2006.01) |
| ***B21C 1/00*** | (2006.01) |
| ***C23G 1/10*** | (2006.01) |
| ***C25D 5/36*** | (2006.01) |

(52) U.S. Cl.
CPC ..... *C25D 5/36* (2013.01); *C25D 5/48* (2013.01); *C25D 7/0607* (2013.01); *D07B 1/0666* (2013.01); *D07B 2205/3089* (2013.01); *Y10T 428/12972* (2015.01)

(56) References Cited

U.S. PATENT DOCUMENTS

| | | | |
|---|---|---|---|
| 2003/0003319 | A1 | 1/2003 | Doujak et al. |
| 2010/0294013 | A1 | 11/2010 | Matsuyama |

FOREIGN PATENT DOCUMENTS

| | | | |
|---|---|---|---|
| JP | 2-175984 | A | 7/1990 |
| JP | 2872682 | B2 | 3/1999 |
| WO | 97/23311 | A1 | 7/1997 |
| WO | 03012174 | A | 2/2003 |
| WO | 2008148407 | A1 | 12/2008 |
| WO | 2011076746 | A1 | 6/2011 |

OTHER PUBLICATIONS

Communication dated Jul. 1, 2015 from the European Patent Office issued in corresponding application No. 12849228.7.

METHOD FOR MANUFACTURING BRASS-PLATED STEEL WIRE AND BRASS-PLATED STEEL WIRE

TECHNICAL FIELD

The present invention relates to a method for manufacturing a brass-plated steel wire (hereinafter, also simply referred to as "manufacturing method") and a brass-plated steel wire, and more particularly, to a method for manufacturing a brass-plated steel wire in which improvement in the quality of the brass-plated steel wire and energy saving in the manufacturing process are balanced and a brass-plated steel wire obtained by the method.

BACKGROUND ART

In a manufacturing process of a brass-plated steel wire represented by a steel cord of a reinforcing material for tires, a pre-drawing is performed generally by dry drawing, and then, a perlite steel structure is built by a patenting thermal treatment, followed by brass plating on the surface of a steel wire rod, and the steel wire rod is subjected to a wet drawing which is a final wire drawing process. As a means for brass plating, a thermal diffusion plating method in which zinc plating is performed on a copper plated layer, and then a brass-plated layer is created by thermal diffusion, is generally employed.

Examples of a technique relating to improvement of a method for manufacturing a brass-plated steel wire include Patent Document 1. Patent Document 1 relates to a method for manufacturing a brass plated bead wire in which a steel wire is plated with copper and zinc sequentially, and then a thermal treatment which corrects wire drawing strain and a thermal diffusion of copper and zinc plated on the steel wire are simultaneously allowed to proceed, and thereafter, the steel wire is subjected to a pickling treatment by an inorganic acid. A brass plated bead wire in which the adhesive properties with rubber are improved without compromising the mechanical properties can thus be obtained.

RELATED ART DOCUMENT

Patent Document

Patent Document 1: Japanese Patent No. 2872682

SUMMARY OF THE INVENTION

Problems to be Solved by the Invention

As a reinforcing material for tires, other than bead wires, a steel cord is often used. In recent years, the performance of a tire is improved, and the quality of a brass-plated steel wire for a steel cord other than a bead wire is desired to be improved. Energy saving in the manufacturing process of a brass-plated steel wire for a steel cord, maintenance of manufacturing facilities or like is also an important issue.

Accordingly, an object of the present invention is to provide a method for manufacturing a brass-plated steel wire in which improvement in the quality of the brass-plated steel wire and energy saving in the manufacturing process are balanced, and a brass-plated steel wire obtained by the method.

Means for Solving the Problems

In order to solve the above-mentioned problems, the present inventor intensively studied a method for manufacturing a brass-plated steel wire to discover the following findings. That is, lubricity in a final wire drawing process is compromised due to zinc oxide generated on the surface of a steel wire by a thermal treatment after plating treatment, and as the result, loss of power consumption due to increase in a drawing force is produced. In addition, since lubricity is compromised due to zinc oxide on the surface of a brass-plated steel wire, friction between the brass-plated steel wire and a die increases, thereby reducing the quality of the brass-plated steel wire. Further, a harmful effect such as shortening of lifetime of a die is demonstrated.

The present inventor intensively studied further on the basis of the above-mentioned findings to find that the above-mentioned problems can be resolved by removing zinc oxide on the surface of a brass-plated steel wire rod before the final wire drawing process of the brass-plated steel wire rod, thereby completing the present invention.

In other words, a manufacturing process of a brass-plated steel wire of the present invention is a method for manufacturing a brass-plated steel wire comprising a plating process in which a steel wire rod is brass plated and a final wire drawing process in which the obtained brass-plated steel wire rod is subjected to a final drawing, the method comprising a zinc oxide removing process in which the amount of zinc oxide on the surface of the brass-plated steel wire rod is made smaller than 50 $mg/m^2$ before the final wire drawing process.

In the manufacturing method of the present invention, preferably, the plating process comprises a process in which copper and zinc are sequentially plated and thereafter, a thermal treatment is performed. In the manufacturing method of the present invention, preferably, zinc oxide removal in the zinc oxide removing process is performed by a pickling treatment. Further, in the manufacturing method of the present invention, preferably, a cleaning liquid used for the pickling treatment is a phosphoric acid solution. Still further, in the manufacturing method of the present invention, preferably, the concentration of the phosphoric acid solution and acid treatment time satisfy the relationship represented by the following expression:

$$\text{phosphate concentration (g/L)} \times \text{treatment time (s)} > 5.0 \ (\text{g/L}\cdot\text{s}).$$

In the manufacturing method of the present invention, preferably, the amount of zinc oxide on the surface of the brass-plated steel wire rod is not smaller than 10 and smaller than 50 $mg/m^2$. Further, in the manufacturing method of the present invention, preferably, the diameter of the brass-plated steel wire is not larger than 0.6 mm. Still further, in the manufacturing method of the present invention, preferably, the thickness of a brass-plated layer on the surface of the brass-plated steel wire is not larger than 20 μm. In the manufacturing method of the present invention, preferably, the final drawing is wet drawing.

The brass-plated steel wire of the present invention is a brass-plated steel wire manufactured by the manufacturing process of a brass-plated steel wire of the present invention.

Effects of the Invention

According to the present invention, a method for manufacturing a brass-plated steel wire in which improvement in the quality of the brass-plated steel wire and energy saving in the manufacturing process are balanced and a brass-plated steel wire obtained by the method can be provided.

MODE FOR CARRYING OUT THE INVENTION

A manufacturing process of a brass-plated steel wire of the present invention will be describe in detail by using the Drawings.

Figure 1:
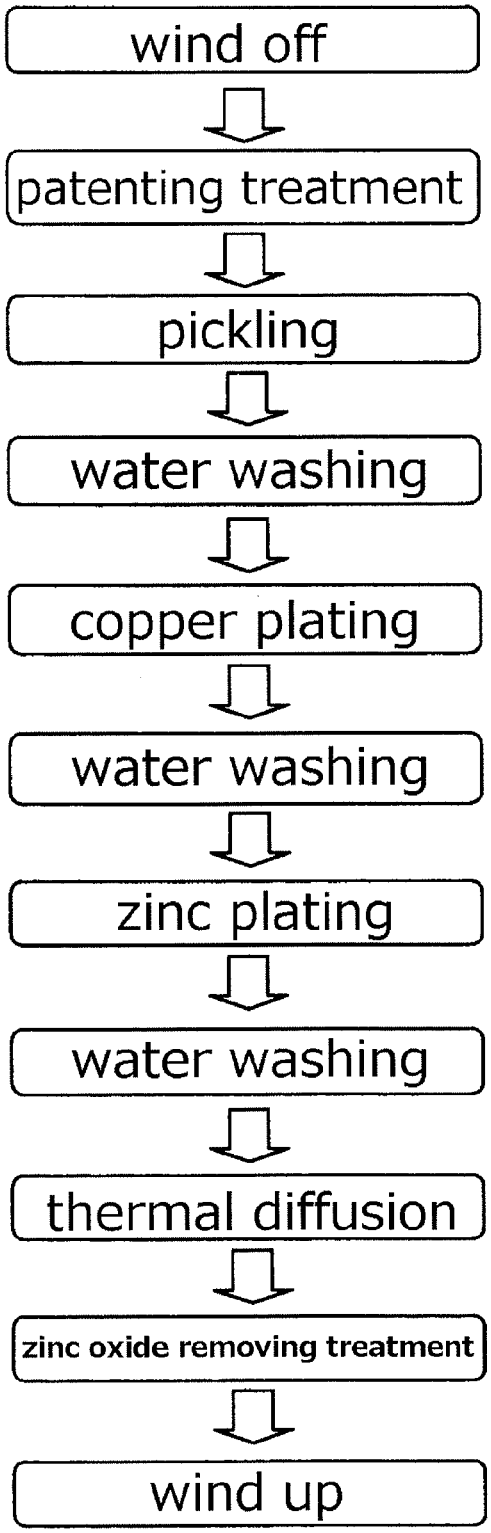
FIG. 1 is a flowchart of one suitable embodiment of the manufacturing method of the present invention.

The manufacturing process of a brass-plated steel wire of the present invention comprises a plating process in which a steel wire rod is brass plated, and a final wire drawing process in which the obtained brass-plated steel wire rod is subjected to a final drawing. FIG. 1 is a flowchart of one suitable embodiment of the present invention. In the illustrated example, firstly, the steel wire rod which has been wound off is subjected to a patenting treatment, and then pickling and water washing, followed by a copper plating treatment. Thereafter, by way of water washing, zinc plating treatment, water washing process, copper and zinc are sequentially plated on the surface of the steel wire rod. Thereafter, by using a thermal diffusion treatment, copper plating and zinc plating are formed into an alloy to become a brass plating.

It is important that the manufacturing method of the present invention comprises a zinc oxide removing process in which the amount of zinc oxide of the surface of a brass-plated steel wire rod is made smaller than 50 $mg/m^2$, specifically not smaller than 10 and smaller than 50 $mg/m^2$ before the final wire drawing process (in FIG. 1, immediately after the thermal diffusion treatment). Zinc oxide on the surface of the brass-plated steel wire rod is thus removed, and electric power for drawing can be reduced, thereby attaining energy saving. By reducing a drawing force, a load on a tool is reduced, whereby wear is reduced and lifetime of a tool such as die is improved. In other words, the wear state of the inner surface of a die is improved, whereby plating cohesion, longitudinal flaw, and ring wear of a die with which a brass-plated steel wire rod subjected to a zinc oxide removing treatment is used are inhibited. Further, while a brass-plated steel wire rod which is not subjected to a zinc oxide removing treatment exhibits a tendency that drawing force increases in accordance with increase in the drawing speed during wire drawing, in a brass-plated steel wire rod which has been subjected to a zinc oxide removing treatment before wire drawing, the drawing force exhibits no dependency on speed. As the result, decrease in the quality of a brass-plated steel wire due to the friction between the brass-plated steel wire rod and the die can be inhibited. When the amount of zinc oxide on the surface of the brass-plated steel wire rod is larger than 50 $mg/m^2$, the formation of a lubrication coating is inhibited by zinc oxide. The lower limit 10 $mg/m^2$ is the amount of inevitable zinc oxide generated by re-oxidation of a brass-plated surface.

In the manufacturing method of the present invention, a zinc oxide removing means in a zinc oxide removing process before final drawing is not particularly restricted, and preferably, the zinc oxide removing is performed by a pickling treatment. An acid which is used in the pickling treatment is also not particularly restricted, and a phosphoric acid is preferably used. When hydrochloric acid is used, hydrochloric acid is mixed into an atmosphere of the manufacturing process and corrodes the steel wire, whereby deterioration in adhesive force or mechanical properties may by caused. As a result, management of preventing dissipation of hydrogen chloride is needed. Since, when sulfuric acid is used, hydrogen embrittlement is caused by a trace amount of remaining sulfuric acid and fatigability deteriorates, a water washing equipment in which acid removal can be sufficiently performed after pickling is needed. From such a standpoint, a preferred inorganic acid is phosphoric acid. Phosphoric acid does not dissipate in an atmosphere, and hydrogen embrittlement is not caused, and even when phosphoric acid is left on a steel wire, phosphoric acid changes into a phosphate, thereby not having an influence on adhesion, which is advantageous.

In the manufacturing method of the present invention, when pickling which uses phosphoric acid as a zinc oxide removing means is adopted, the concentration and cleaning time of phosphoric acid are not particularly restricted, and preferably the concentration and pickling treatment time of phosphoric acid preferably satisfy the following relational expression:

$$\text{phosphate concentration (g/L)} \times \text{treatment time (s)} > 5.0 \ (\text{g/L}\cdot\text{s}).$$

By satisfying the above relational expression, the amount of zinc oxide on the brass-plated steel wire rod can be sufficiently reduced.

In the manufacturing method of the present invention, a means for brass plating a steel wire rod is not particularly restricted. As illustrated in FIG. 1, copper and zinc are sequentially plated, and thereafter, a brass-plated layer may be formed by performing a thermal diffusion treatment, or a brass-plated layer may be formed by plating copper and zinc simultaneously. In the manufacturing method of the present invention, the drawing method in the final wire drawing process may be dry drawing or wet drawing. When a brass-plated steel wire is used as a steel cord, since the filament diameter of the brass-plated steel wire after the final drawing is 0.6 mm or smaller, wet drawing is preferably employed. The thickness of a brass-plated layer after the final drawing is similar to that of a normal brass-plated steel wire, and preferably is less than 20 μm.

The steel wire rod which is used in a manufacturing process of a brass-plated steel wire of the present invention may be any steel wire rod as long as it is normally used for a steel cord. Any diameter or material of the steel wire rod may be used as long as it is known, and suitably, a high carbon steel wire having a carbon content of 0.70% by mass or higher is used as the steel wire rod. Regarding the drawing process, a drawing condition or the like is not particularly limited as long as wire drawing is performed in accordance with a conventional method by using a wire drawing machine which is normally used in a drawing process of a steel wire rod.

Next, a brass-plated steel wire of the present invention will be described.

The brass-plated steel wire of the present invention is obtained by the above-mentioned manufacturing method of the present invention. The brass-plated steel wire of the present invention is suitably used for a steel cord. The brass-plated steel wire of the present invention is suitable for a reinforcing material for tires. The brass-plated steel wire of the present invention may be used as a monofilament cord, or a plurality of the brass-plated steel wires of the present invention may be twisted together to be used as a twisted cord.

EXAMPLES

In the following, the manufacturing method of the present invention will be described in detail by using Examples.

Examples 1-9 and Comparative Examples 1-3

A high carbon steel wire rod having a diameter of 1.86 mm and a carbon content of 0.82% by mass was subjected to dry drawing and drawn to a diameter of 0.36 mm. Next, the obtained high carbon steel wire rod was subjected to copper plating and zinc plating sequentially, and a brass-plated high carbon steel wire rod was obtained by a thermal diffusion treatment. The obtained brass-plated high carbon steel wire rod was subjected to a pickling treatment by phosphoric acid in conditions listed on Table 1 below. The amount of zinc oxide which was remained on the surface of the brass-plated steel wire rod after the pickling treatment is listed on Table 1 in combination.

Conventional Example

The amount of zinc oxide which was remained on the surface of the brass-plated steel wire rod was determined in a similar manner to Example 1 except that a pickling treatment by phosphoric acid was not performed. The results are listed on Table 1 in combination.

<Evaluation of Lifetime of Die and Electric Power for Drawing>

The brass-plated steel wire rod after the pickling treatment is subjected to wet drawing. The lifetime of the first die of a wet drawing machine and the decrease rate of power consumed by the wet drawing were evaluated as indices taking Conventional Example as a reference. The obtained results are listed on Table 1 in combination. Regarding the criteria in Table 1, when the lifetime of the die was 300 or longer and the power decreasing rate was 5 or higher, the evaluation was "◎"; when the lifetime of the die was 200 or longer and shorter than 300 and the power decreasing rate was 3 or higher and lower than 5, the evaluation was "○"; when the lifetime of the die was 100 or longer and shorter than 200 and the power decreasing rate was 1 or higher and lower than 2, the evaluation was "Δ"; when an improved effect was not found (when a pickling treatment was not performed), the evaluation was "×".

<Die Reaction>

Figure 2:
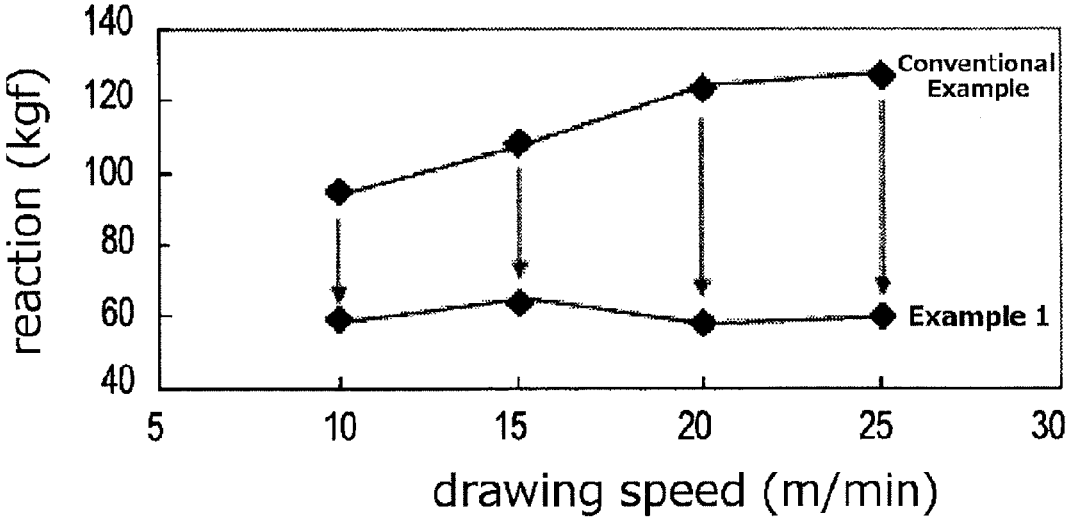
FIG. 2 is a graph illustrating the relationships between a drawing speed and a die reaction during wet drawing of brass-plated steel wire rods of Example 1 and Conventional Example.

The relationships between a drawing speed and a die reaction during wet drawing of brass-plated steel wire rods of Example 1 and Conventional Example are illustrated in FIG. 2. In the measurement of a die reaction, a sensor was mounted on an actual machine, and die reactions of three dies of all dies from the most upstream of drawing process were measured, and the average of the obtained values was defined as a die reaction.

TABLE 1

| | Condition | | | Amount | Effect | | |
|---|---|---|---|---|---|---|---|
| | phosphate concentration (g/L) | treatment time (s) | phosphate concentration × treatment time (g/L · s) | of zinc oxide remained ($mg/m^2$) | lifetime of die (index) | power decreasing rate (index) | judgment |
| Example 1 | 60 | 1.2 | 72 | 23 | 300 or longer | 5 | ◎ |
| Example 2 | 60 | 0.4 | 24 | 23 | 300 or longer | 5 | ◎ |
| Example 3 | 60 | 0.2 | 12 | 27 | 300 or longer | 5 | ◎ |
| Example 4 | 60 | 0.1 | 6 | 40 | 200 | 3 | ○ |
| Example 5 | 30 | 1.2 | 36 | 23 | 300 or longer | 5 | ◎ |
| Example 6 | 30 | 0.4 | 12 | 27 | 300 or longer | 5 | ◎ |
| Example 7 | 30 | 0.2 | 6 | 31 | 300 or longer | 5 | ◎ |
| Comparative Example 1 | 30 | 0.1 | 3 | 50 | 100 | 1 | Δ |
| Example 8 | 10 | 1.2 | 12 | 27 | 300 or longer | 5 | ◎ |
| Example 9 | 10 | 0.4 | 4 | 46 | 200 | 3 | ○ |
| Comparative Example 2 | 10 | 0.2 | 2 | 59 | 100 | 1 | Δ |
| Comparative Example 3 | 10 | 0.1 | 1 | 69 | 100 | 1 | Δ |
| Conventional Example | — | — | — | 127 | 100 | 0 | X |

Table 1 shows that, by the manufacturing method of the present invention, the lifetime of a die is improved. This means that decrease in the quality of a brass-plated steel wire can be inhibited. It is also shown that the power consumption needed for wire drawing can be inhibited. Further, FIG. 2 shows that the drawing force is not dependent on the speed.

The invention claimed is:

1. A method for manufacturing a brass-plated steel wire, comprising:

brass-plating a steel wire rod;

removing zinc oxide from the surface of the brass-plated steel wire rod by a pickling treatment, wherein the amount of zinc oxide remaining after the removing of the zinc oxide is smaller than 50 $mg/m^2$; and final drawing the obtained brass-plated steel wire rod after the removing of the zinc oxide;

wherein a cleaning liquid used for the pickling treatment is a phosphoric acid solution; and wherein the concentration of the phosphoric acid solution and acid treatment time satisfy the relationship represented by the following expression: 72 (g/L·s)≥phosphate concentration (g/L)×treatment time (s)>5.0 (g/L·s).

2. The method for manufacturing a brass-plated steel wire according to claim 1, wherein the brass-plating of the steel wire rod comprises a process in which sequentially plating copper and zinc, and thereafter performing a thermal treatment.

3. The method for manufacturing a brass-plated steel wire according to claim 1, wherein the amount of zinc oxide on the surface of the brass-plated steel wire rod after the removing of the zinc oxide is not smaller than 10 and is smaller than 50 $mg/m^2$.

4. The method for manufacturing a brass-plated steel wire according to claim 1, wherein the diameter of the brass-plated steel wire after the final drawing process is not larger than 0.6 mm.

5. The method for manufacturing a brass-plated steel wire according to claim 1, wherein the thickness of a brass-plated layer on the surface of the brass-plated steel wire after the final drawing process is not larger than 20 μm.

6. The method for manufacturing a brass-plated steel wire according to claim 1, wherein the final drawing is wet drawing.

7. A brass-plated steel wire manufactured by the method for manufacturing a brass-plated steel wire according to claim 1.

* * * * *